United States Patent [19]

Windeler et al.

[11] 4,454,996

[45] Jun. 19, 1984

[54] COMBINATION RIBBON STRING-UP AND WINDER APPARATUS

[75] Inventors: Christopher L. Windeler, Chester; Henry S. DeVore, Long Valley; David B. Seal, North Caldwell; Boleslaw L. Budzyn, Passic, all of N.J.

[73] Assignee: Allied Corporation, Morris Township, Morris County, N.J.

[21] Appl. No.: 461,288

[22] Filed: Jan. 27, 1983

[51] Int. Cl.[3] ..... B65H 54/02; B65H 65/00

[52] U.S. Cl. ..... 242/25 R; 242/18 R; 242/18 PW; 242/47

[58] Field of Search ..... 242/25 R, 25 A, 18 R, 242/18 PW, 18 A, 78, 78.1, 78.3, 47

[56] References Cited

U.S. PATENT DOCUMENTS

| | | | |
|---|---|---|---|
| 3,938,583 | 2/1976 | Kavesh | 164/276 |
| 3,980,244 | 9/1976 | Pietroni | 242/25 A |
| 4,023,741 | 5/1977 | Schar | 242/18 PW |
| 4,142,571 | 3/1979 | Narasimhan | 164/88 |
| 4,239,187 | 12/1980 | Boggs et al. | 242/25 R |

*Primary Examiner*—Stanley N. Gilreath

*Attorney, Agent, or Firm*—Paul Yee; Ernest D. Buff; Gerhard H. Fuchs

[57] ABSTRACT

The apparatus and method of this invention provides for the automatic, inline string-up of a rapidly advancing filament, particularly a glassy alloy strip, from a high speed continuous casting operation onto a rotating winding wheel. A take-up head comprised of two counter-rotating brush rollers having selectable interference and speed of counter rotation captures a leading segment of the advancing filament. The brush rollers are mounted on a carrier arm pivotable about the rotational axis of the winding wheel. As an actuator mechanism pivots the carrier arm, the brush rollers move around the winding wheel to contact a segment of the filament with the winding surface of the wheel. A cut and grip device then cuts the filament at the winding surface and secures the filament to the winding wheel. Thereafter, inline winding of the filament proceeds.

14 Claims, 21 Drawing Figures

FIG-8A
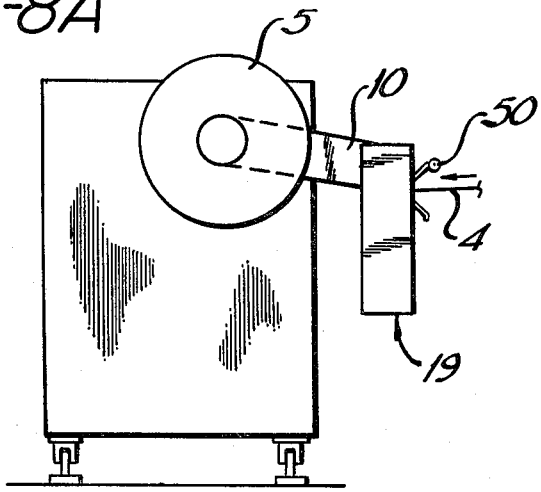
FIG-8B
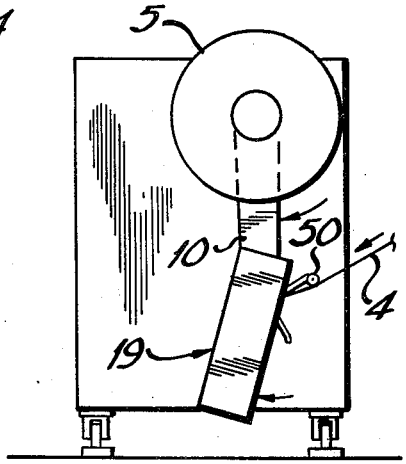
FIG-8C
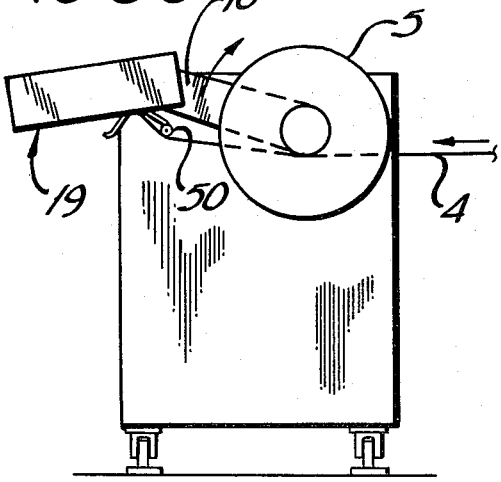
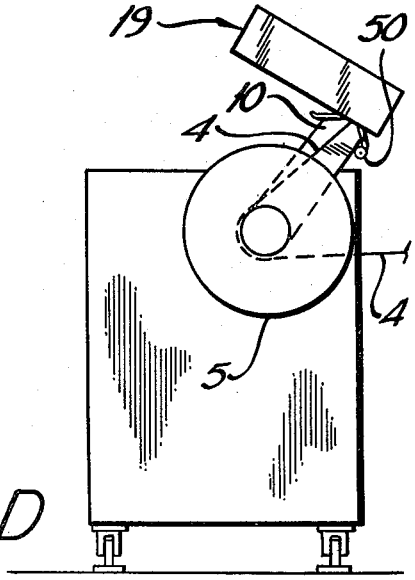
FIG-8D

FIG-9A
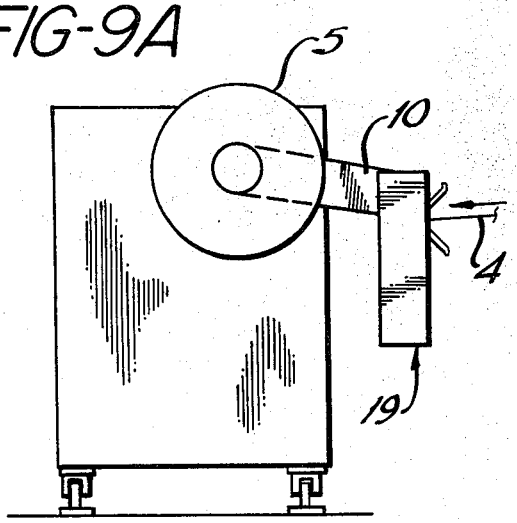
FIG-9B
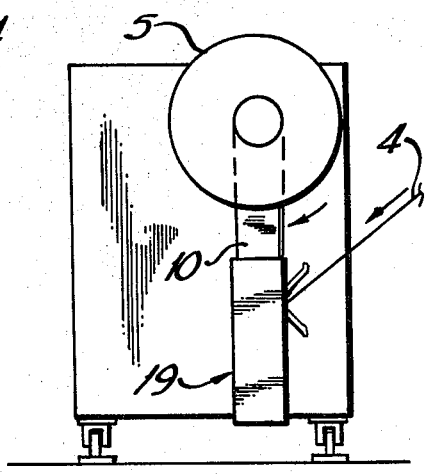
FIG-9C
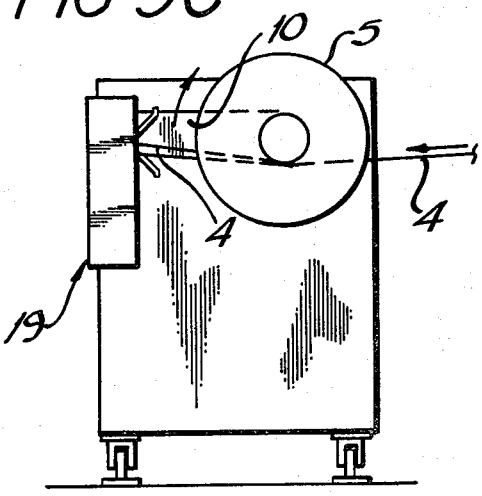
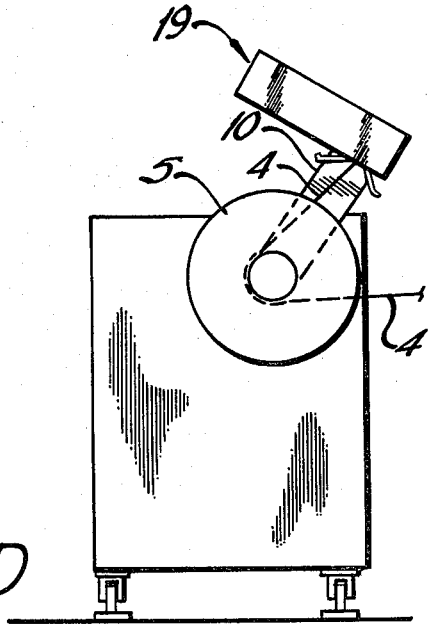
FIG-9D 45
43
44
30
10
23
46
23
31
19
26
10
29

COMBINATION RIBBON STRING-UP AND WINDER APPARATUS

DESCRIPTION

BACKGROUND OF THE INVENTION

1. Field of the Invention

The present invention relates generally to the string-up of the leading portion of a continuous filament inline from a continuous forming operation onto a take-up device. More particularly, it relates to the winder string-up of the leading portion of a continuous metal filament, such as a glassy alloy strip, moving at high speed as it departs a moving quench surface in a high speed continuous casting process.

2. Description of the Prior Art

In the production of glassy alloy continuous filaments, typically an appropriate molten alloy is quenched at extreme quench rates, usually at least about $10^4$° C. per second by extruding the molten alloy from a pressurized reservoir through an extrusion nozzle onto a high speed rotating quench surface, as is representatively shown in U.S. Pat. No. 4,142,571 for "Continuous Casting Method for Metallic Strips" issued Mar. 6, 1978, to M. Narasimhan, which is hereby incorporated by reference thereto. Such filaments are necessarily thin, typically about 25–100 microns, because of the extreme heat transfer rate required to prevent substantial crystallization, though considerable selectivity may be exercised respecting the transverse dimension and cross-section of the filament. Thus, hereinafter in the specification and claims, the term filament is intended to include strips, both narrow and wide, as well as wire-like filaments.

It is commercially desirable to wind the filament inline with its casting process, as representatively shown in U.S. Pat. No. 3,938,583 "Apparatus for Production of Continuous Metal Filaments" issued Feb. 17, 1976, to S. Kavesh. However, initiation of winding inline with a casting process is especially difficult for at least two reasons. First, linear casting speeds are high, and string-up must be accomplished quickly and precisely; otherwise an entangled mass of filament accumulates rapidly. Second, the tension exerted on the filament during string-up must be maintained within limits. Tension must be sufficient to substantially dampen disrupting oscillations of the filament (excessive "flutter") but not so much as to disrupt the quenching operation.

A typical winder string-up apparatus, with counter-rotating brush rollers traveling along a raised track, is shown in U.S. Pat. No. 4,239,187 "Winder String-Up Method and Apparatus" issued Dec. 16, 1980 to B. Boggs, et al.

The device disclosed in Boggs, et al., however, lacks sufficient maneuverability. If the string-up apparatus should miss capturing the leading edge of the advancing filament, the filament may become entangled in the associated winder apparatus ruining the cast material and causing the material to be scrapped. Also, improved means for increasing the filament contact are around the winding wheel is needed to provide a more versatile cut and grip operation, and a modulated rate of filament transfer is needed to minimize breakage of the filament. Thus, there is continued need for a more maneuverable and efficient string-up apparatus which provides an increased filament contact arc and modulated rate of movement.

SUMMARY OF THE INVENTION

The invention provides an improved apparatus for the inline string-up of a rapidly advancing filament from a continuous forming operation onto a winding wheel rotating about a concentric axis of rotation. A take-up head rotatable about a head axis captures an advancing segment of the filament, preferably with two nipping brush rollers having selectable interference and speed of counter-rotation. The brush rollers are adapted to pass the filament through the nip thereof and produce a sliding, frictional tensioning of the filament. The take-up head connects to a carrier arm which is pivotable about the rotational axis of the winding wheel. An actuator means pivots the carrier arm to move the take-up head around the winding wheel and contact a segment of the filament with the winding surface of the wheel. A grip means then severs the filament at the winding surface, such as by cutting or breaking, and secures it to the winding wheel. Thereafter, the inline winding of the filament proceeds. Optionally, the apparatus also includes a hold down means which accentuates the contact arc of the filament on the winding surface.

The invention also provides a method for the inline string-up of a rapidly advancing filament from a continuous forming operation onto a winding wheel rotating about a concentric axis of rotation. An advancing segment of the filament is captured in a take-up head, preferably comprised of two nipping brush rollers having selectable interference and speed of counter-rotation. The take-up head is pivotably moved along a predetermined, substantially circular path around the rotational axis of the winding wheel to contact a segment of the filament with a winding surface of the wheel. The filament is then severed at the winding surface, and the advancing segment of the filament is secured to the winding wheel.

The apparatus of the invention is a maneuverable, compact device having a filament transfer means and a winding means together in an efficient and reliable unit. If the filament is not captured, the whole apparatus can be maneuvered to avoid entanglements around the winding wheel which might otherwise ruin the cast filament. The apparatus of the invention provides a larger filament contact arc around the winding wheel surface. The larger contact arc provides a larger "target window" toward which to direct the cut and grip mechanism and thereby improves the reliability of the cut and grip operation. The larger target window also improves the versatility of the device since the trigger timing of the cut and grip mechanism need not be readjusted whenever the winding speed of the winder wheel is changed to accommodate the different casting speeds required by different filament compositions. The apparatus further provides a modulated, sinusoidal-type filament transfer rate having a slow rate during the beginning of travel, a faster rate during mid-travel, and a slow rate during the end of travel. This modulated transfer rate minimizes filament breakage and eliminates the corresponding disruption of the casting operation.

Thus, the invention provides an automatic, compact and maneuverable apparatus for filament string-up that is more efficient, reliable and versatile than ordinary devices having separated string-up means moved along a raised track. The apparatus reliably transfers an advancing filament onto a winding wheel, provides a more efficient cut and grip operation and reduces filament breakage.

BRIEF DESCRIPTION OF THE DRAWINGS

The invention will be more fully understood and further advantages will become apparent when reference is made to the following detailed description of the preferred embodiment of the invention and the accompanying drawings in which:

FIGS. 8A, B, C and D show schematically the motion sequence of an alternate apparatus alignment means;

FIGS. 9A, B, C and D show schematically the motion sequence of another alignment means which selectively aligns the take-up head;

DESCRIPTION OF THE PREFERRED EMBODIMENTS

Figure 1:
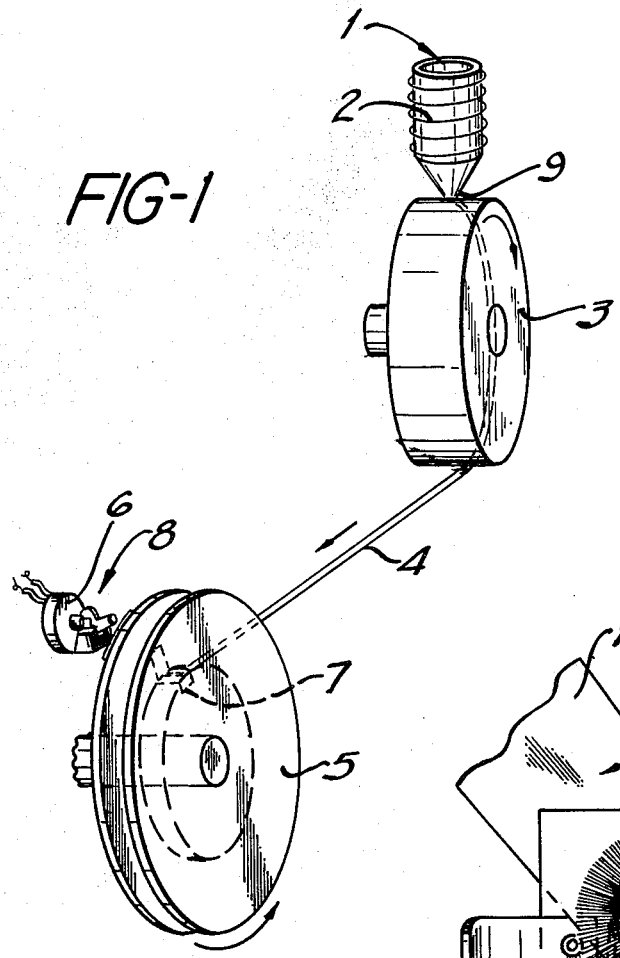
FIG. 1 is a representative apparatus for the continuous casting and inline winding of glassy alloy filaments, wherein molten alloy is extruded through a nozzle onto a quench roll with a solidified filament being wound directly onto a winding wheel.

Referring specifically to the drawings in FIG. 1, a representative apparatus for the continuous casting of a glassy alloy filament is illustrated to point out the general use of the present invention. Molten alloy contained in crucible 1 is heated by a heating element 2. Pressurization of the crucible with an inert gas extrudes a molten stream through a nozzle 9 at the base of the crucible onto a rotating quench wheel 3. Solidified, moving filament 4, after its break-away point from the quench wheel, is routed onto a winding wheel 5, which may be provided with a torque controller (not shown) to regulate the winding tension exerted on the filament. A grip means 8 then secures the filament to wheel 5.

Filament string-up begins by capturing an advancing portion of the filament in a string-up means, such as one provided by the apparatus of this invention. The string-up means moves to contact the advancing filament with the core of the winding wheel, rotating at a speed approximately matching that of the advancing filament. A trigger device 6, such as a photoelectric sensor and solenoid, then releases a spring loaded, pivotal gripping element 7 associated with the winding wheel to cut and secure the advancing filament 4 to the wheel 5, whereupon winding proceeds inline with the casting process. Representative examples of such a cut and grip apparatus are shown in U.S. Pat. No. 4,116,394 "Moving Filament Gripping Mechanism" issued Sept. 26, 1978 to R. Smith et al., which is hereby incorporated by reference thereto.

Winder string-up of an advancing glassy alloy filament in the above-described manner is especially difficult and tedious due to the high speed of the filament, typically up to 2,200 meters per minute. Glassy alloy filaments are spun at this high speed to achieve the extremely rapid quench rate required to produce an amorphous alloy having desired characteristics.

Figure 2:
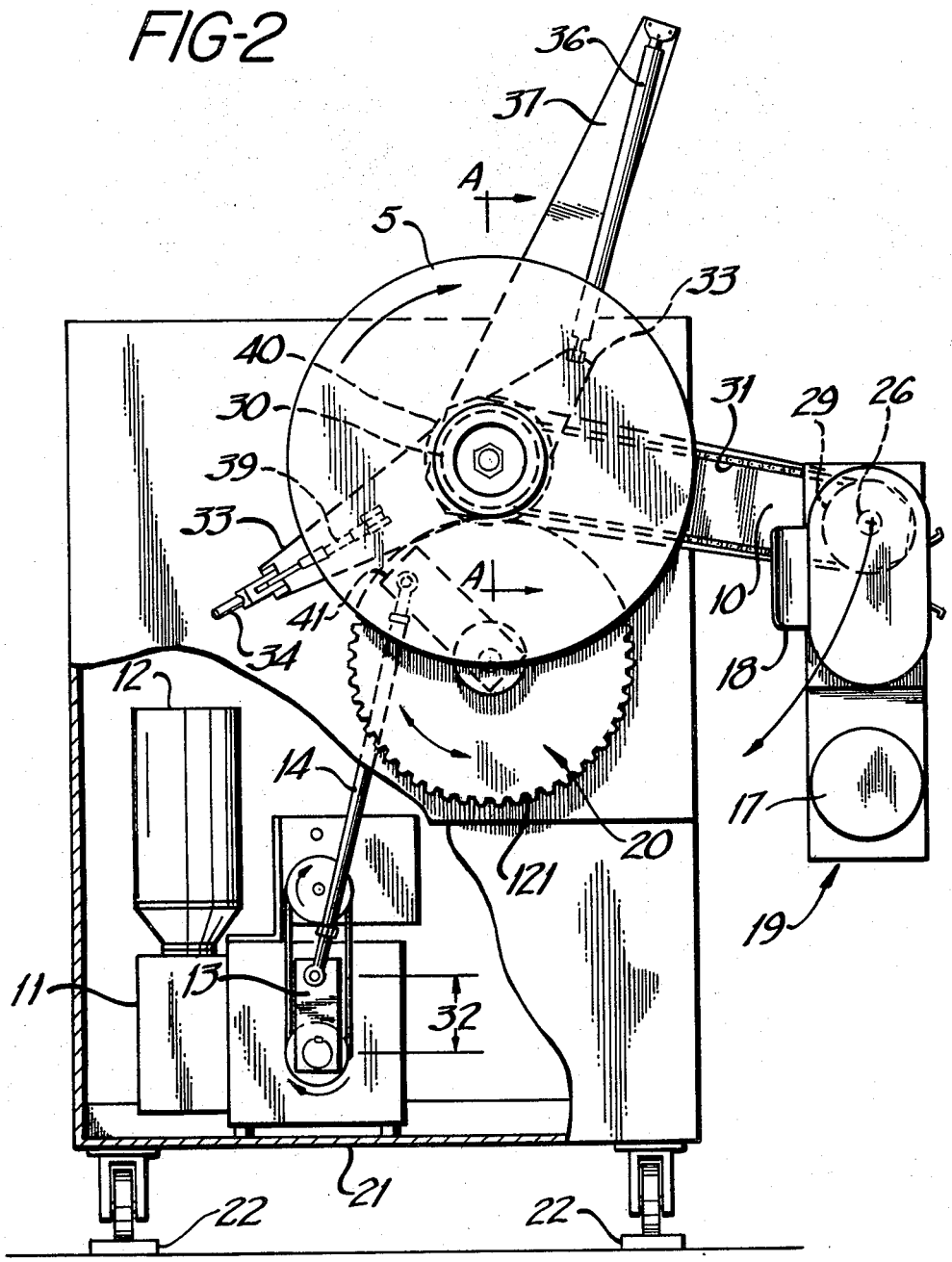
FIG. 2 shows an overall side elevational view of the apparatus of the invention.
Figure 3:
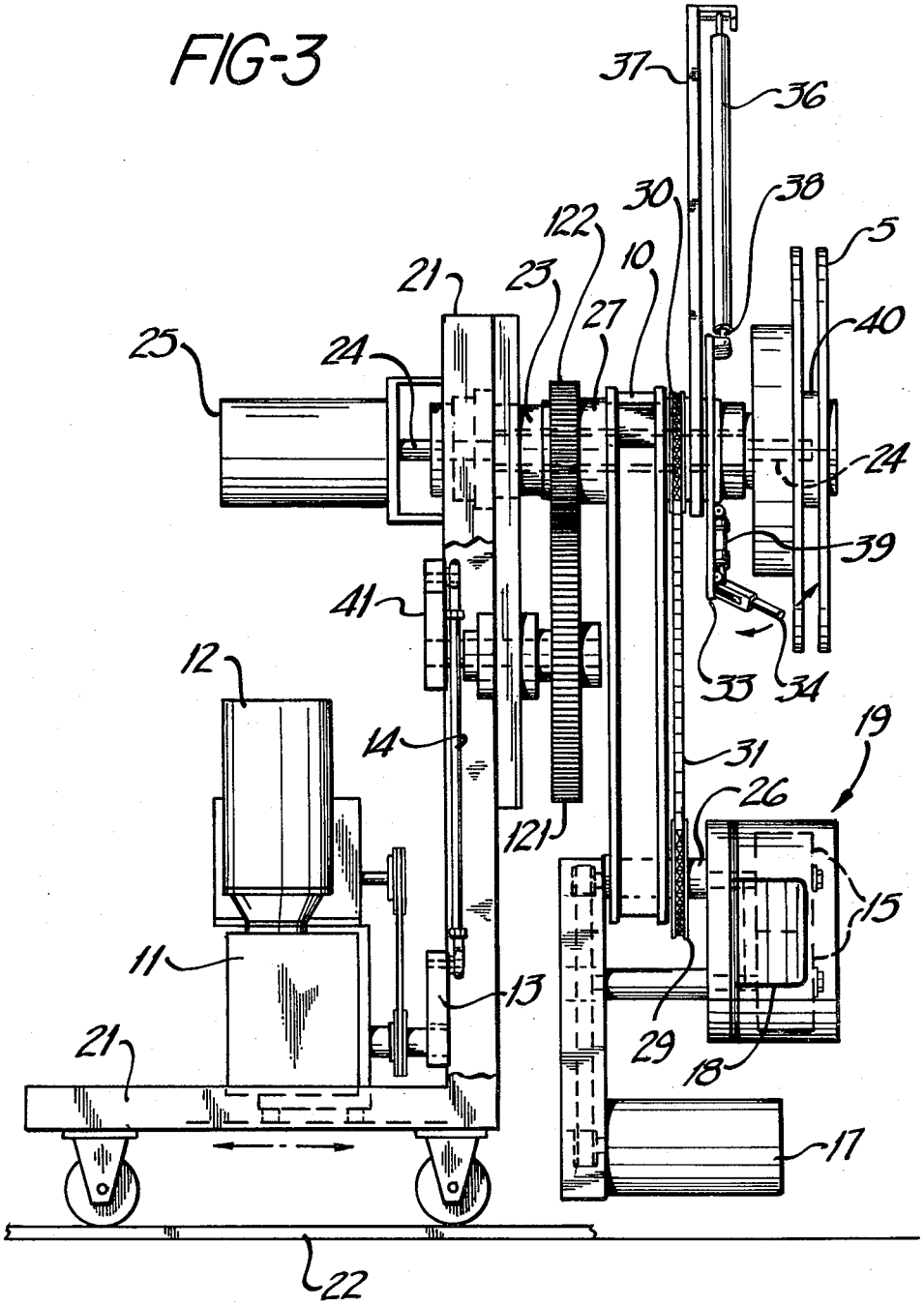
FIG. 3 shows an end view of the apparatus in which the carrier arm is displaced about 90° clockwise from the position shown in FIG. 2.
Figure 5:
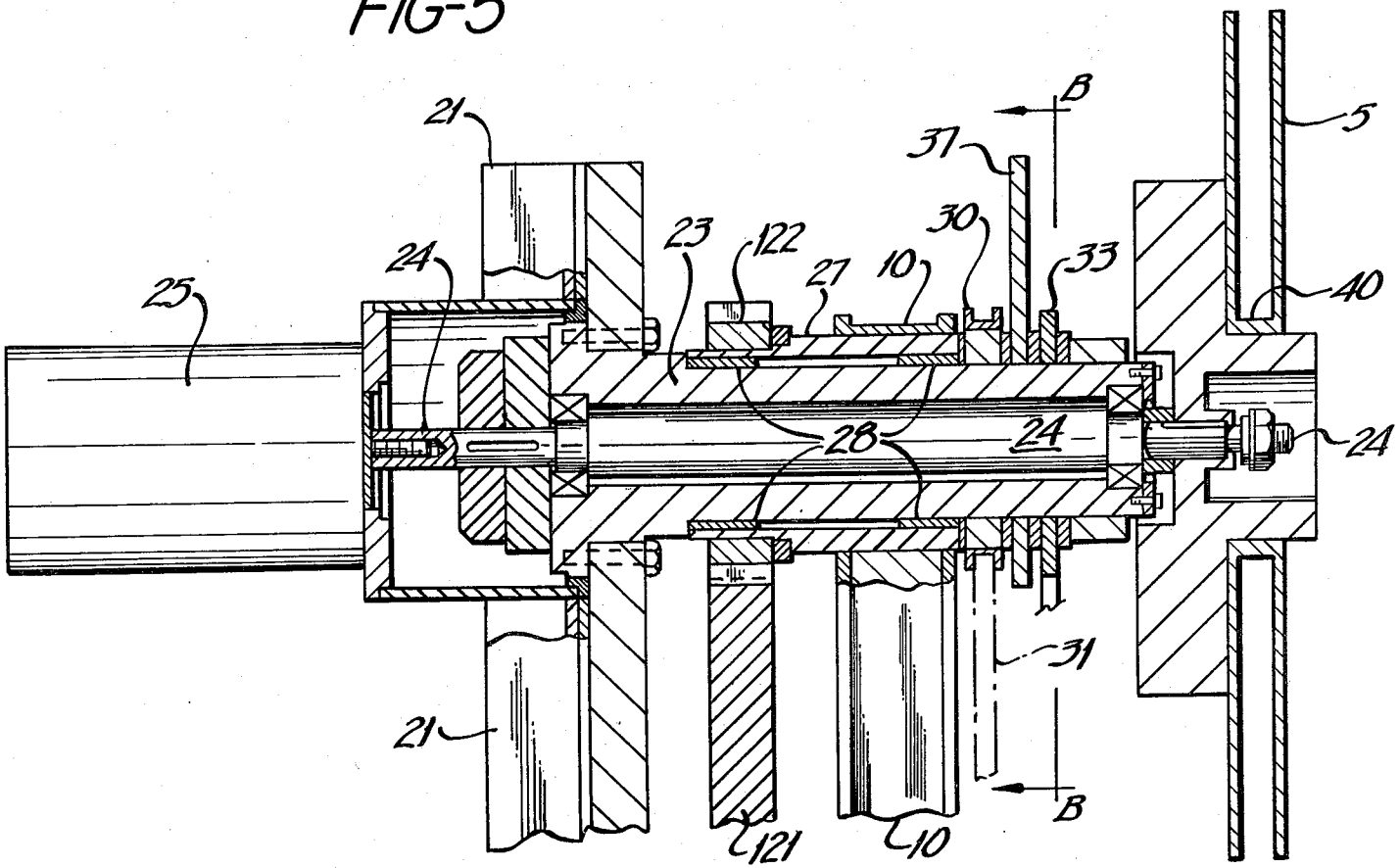
FIG. 5 is an enlarged cross-sectional view taken along line A—A of FIG. 2.

FIGS. 2 and 3 show the apparatus of the invention supported by a suitable frame 21, which preferably is provided with a positioning means 22, such as wheels, tracks, rails or the like. Positioning means 22 allow the apparatus to be precisely aligned with the associated casting operation and also allow the apparatus to be quickly removed from the path of the advancing filament, if desired, to avoid entanglements. A tubular shaft housing 23 is suitably positioned and mounted on frame 21, and shaft 24 is positioned through housing 23 for concentric rotation therein, as shown in FIG. 5. Winding wheel 5 is connected to the end of shaft 24 for rotation therewith, and winder motor 25 drives shaft 24 and winding wheel 5 at a desired rotational velocity.

As shown in FIGS. 2 and 3, the string-up means of the invention is comprised of a take-up head 19 and a carrier means, such as carrier arm 10. Take-up head 19 connects to the end of carrier arm 10 and is rotatable about head shaft 26. The carrier arm, being connected to pivot about the rotational axis of winding wheel 5, moves take-up head 19 along a predetermined, substantially circular path around winding wheel 5 to contact a segment of filament 4 with the winding surface of the wheel. Preferably, an alignment means maintains the entrance to take-up head 19 in a preselected orientation with respect to the advancing filament as the take-up head moves about the winding wheel. An actuator means 11 pivots carrier arm 10 about the rotational axis of winding wheel 5 and preferably, includes a rate means for providing a modulated rate of movement thereto. An optional hold down means then accentuates the contact arc of the filament on the wheel winding surface, and a grip means severs filament 4 at the winding surface and secures it onto winding wheel 5.

Figure 11:
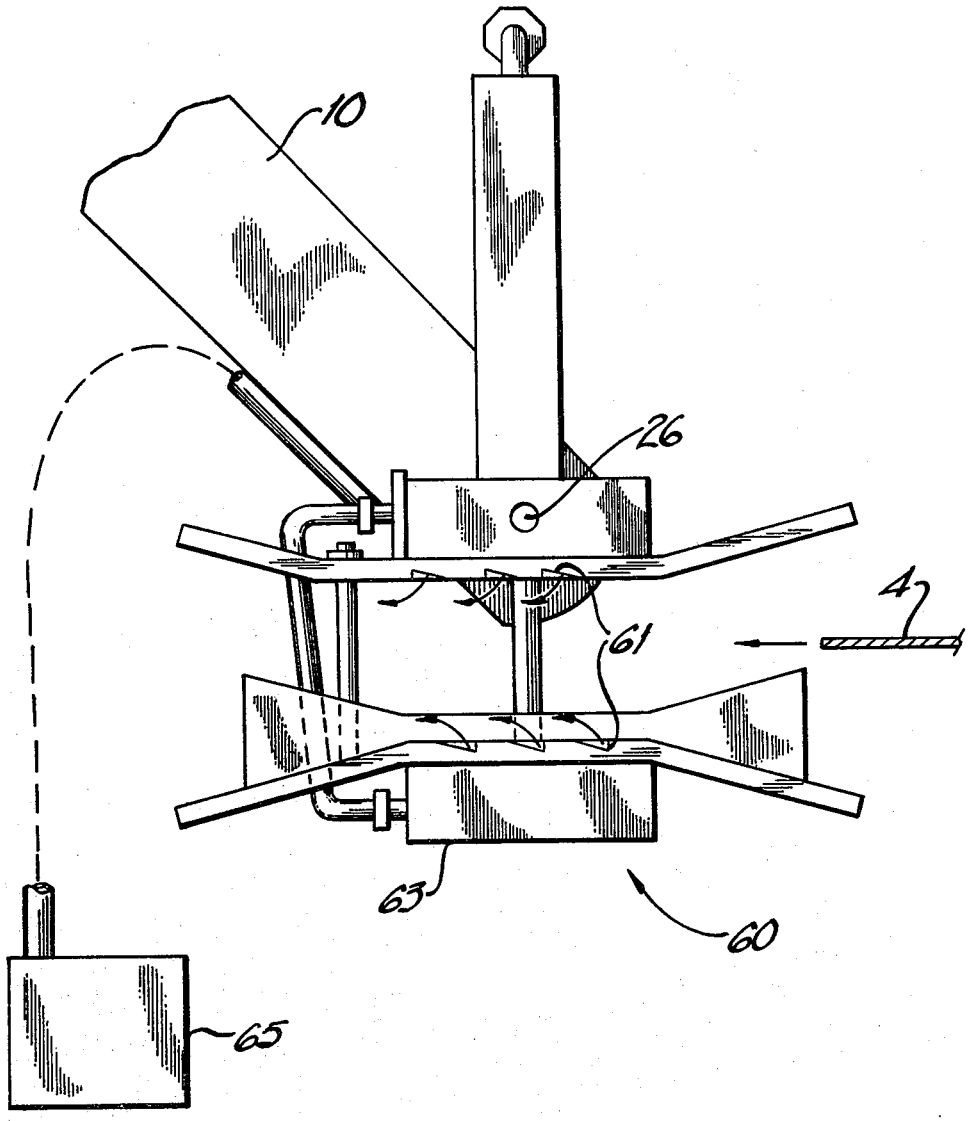
FIG. 11 illustrates an aspirator type take-up head connected to the apparatus carrier arm.

FIG. 11 shows a representative take-up head comprised of an aspirator means 60. During operation of aspirator 60, a fluid source 65 provides a pressurized fluid, such as air, to fluid jet openings 61 located within aspirator body 63. The resultant fluid jets produced through openings 61 capture and tension advancing filament 4 within the aspirator body. An aspirator string-up device suitable for use with the invention is disclosed in copending U.S. patent application Ser. No. 406,663 for "Winder String-Up Aspirator" filed Aug. 9, 1982 by H. L. Li, which is hereby incorporated by reference thereto.

Figure 6:
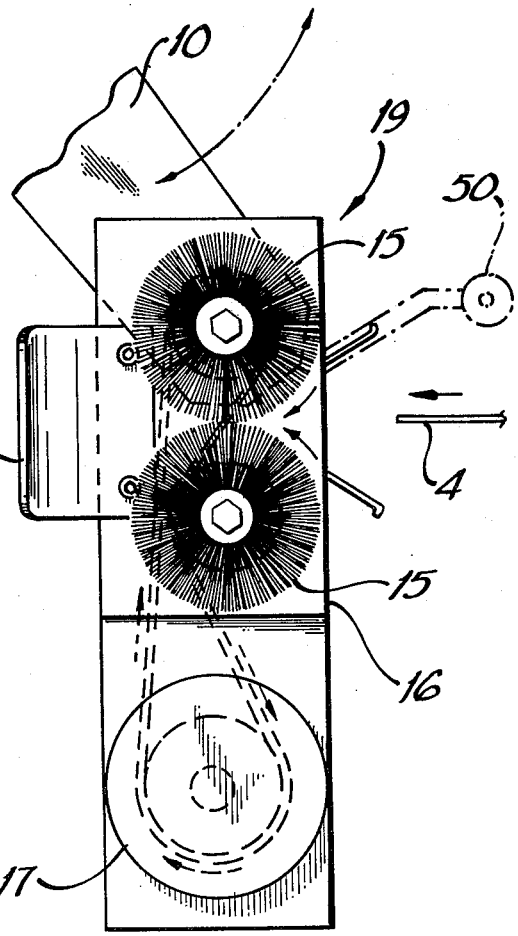
FIG. 6 shows a schematic representation of a take-up head used in the invention.

Preferably, as shown in FIG. 6, take-up head 19 is comprised of two nipping brush rollers 15 having selectable interference and speed of counter-rotation, which are adapted to pass filament 4 through the nip thereof and tension the filament in a sliding frictional manner. Such brush rollers are mounted in a suitable frame 16 with an associated drive motor 17.

A take-up basket contains the advanced segment of the filament or preferably, a simple deflector plate 18 deflects the advanced segment to the side as scrap for later recycle. The configuration is rotatably connected to the end of carrier arm 10 and pivots about a head axis, such as shaft 26 which is substantially parallel to the rotational axis of winding wheel 5. Guide roller 50 is optionally connected to take-up head 19 to minimize friction and guide filament 4 to the nip entrance 47 of brush rollers 15 during movement of the take-up head about wheel 5.

Carrier arm 10 extends radially from shaft housing 23 and connects to a carrier shaft 27 mounted on bearing 28. Bearing 28 and shaft 27 are both disposed concentric with shaft housing 23. Thus, carrier arm 10 is pivotable about the rotational axis of winding wheel 5 to move take-up head 19 along a predetermined, substantially circular path around winding wheel 5.

Where take-up head 19 is rigidly connected to arm 10, it is readily apparent that any rotation of carrier arm 10 about the rotational axis of wheel 5 also rotates the orientation of take-up head 19 with respect to the advancing filament. This can interfere with the free movement of filament 4 into the brush roller nip area. To overcome the interference, an alignment means maintains the entrance to the take-up head and brush roller nip area in a preselected orientation with respect to the advancing filament as carrier arm 10 pivots to move take-up head 19 about the rotational axis of winding wheel 5. In one embodiment of the invention, the alignment means is comprised of drive chain 31 and sprockets 29 and 30, which have approximately a 1:1 sprocket gear ratio. Shaft sprocket 30 is rigidly mounted concentric and non-rotatable with respect to shaft housing 23. Head sprocket 29 is rigidly mounted on and non-rotatable with respect to take-up head 19 with its sprocket axis substantially colinear with the axis of shaft 26. Chain 31 forms a continuous loop drive linkage which engages both sprockets 29 and 30 and is adapted to maintain the desired orientation of take-up head 19 with respect to the advancing filament. For example, take-up 19 can be continuously reoriented to have the entrance to the nip area of brush rollers 15 facing the advancing filament, and the described arrangement of sprockets 29 and 30 and chain 31 effectively counter-rotates take-up head 19 to substantially maintain the initial facing orientation, as representatively shown in FIGS. 4A–E.

The alignment means can be further adapted to compensate for changes in the filament approach direction caused by the wrapping of as filament 4 around wheel 5. Referring to FIG. 8, it is readily apparent that the filament approach direction changes from a generally horizontal direction of travel, as shown by FIGS. 8A–C, to one having an increased vertical component of travel direction as shown by FIG. 8D. To compensate for the change in the filament approach direction, take-up head 19 can be selectively rotated about shaft 26 to reorient and maintain the entrance to the nip area of brush rollers 15 into a preselected, aligned position relative to the approach direction of advancing filament 4.

FIGS. 8A–D illustrates an apparatus motion sequence where the sprocket gear ratio of sprocket 29 to sprocket 30 is about 2:1 to provide a reduced rate of counter-rotation to take-up head 19. In such case, guide roller 50 facilitates the free movement of filament 4 into the brush roller nip area during the initial portions of the motion sequence. During the latter portions of the motion sequence, the take-up head becomes aligned to provide a substantially "straight-in" filament approach direction. This motion sequence allows a greater movement of carrier arm 10 about wheel 5 and increases the filament contact arc thereon.

FIGS. 9A–D illustrate an alternative motion sequence where the reorientation of take-up head 19 coordinates with the movement of carrier arm 10 around wheel 5 to maintain a substantially direct, straight-in passage of the filament into the entrance to the brush roller nip area. This preferred reorientation avoids overstressing and breaking filament 4 prior to the cut and grip operation, and also allows greater movement of carrier arm 10 about wheel 5 to increase the contact arc of filament 4 about the wheel.

To provide the desired reorientation of take-up head 19, head sprocket 29 remains connected to take-up head 19 concentric with the axis of shaft 26. Shaft sprocket 30 is mounted concentric and selectively rotatable with respect to the rotational axis of wheel 5, and chain 31 operably engages shaft sprocket 30 and head sprocket 29. A synchronizer means, such as a combination of a synchronizer drive linkage and a synchronizer drive means, selectively rotates shaft sprocket 30 in coordination with the movement of carrier arm 10 to provide a substantially direct, straight-in approach direction of the filament into nip entrance 47.

Figure 10:
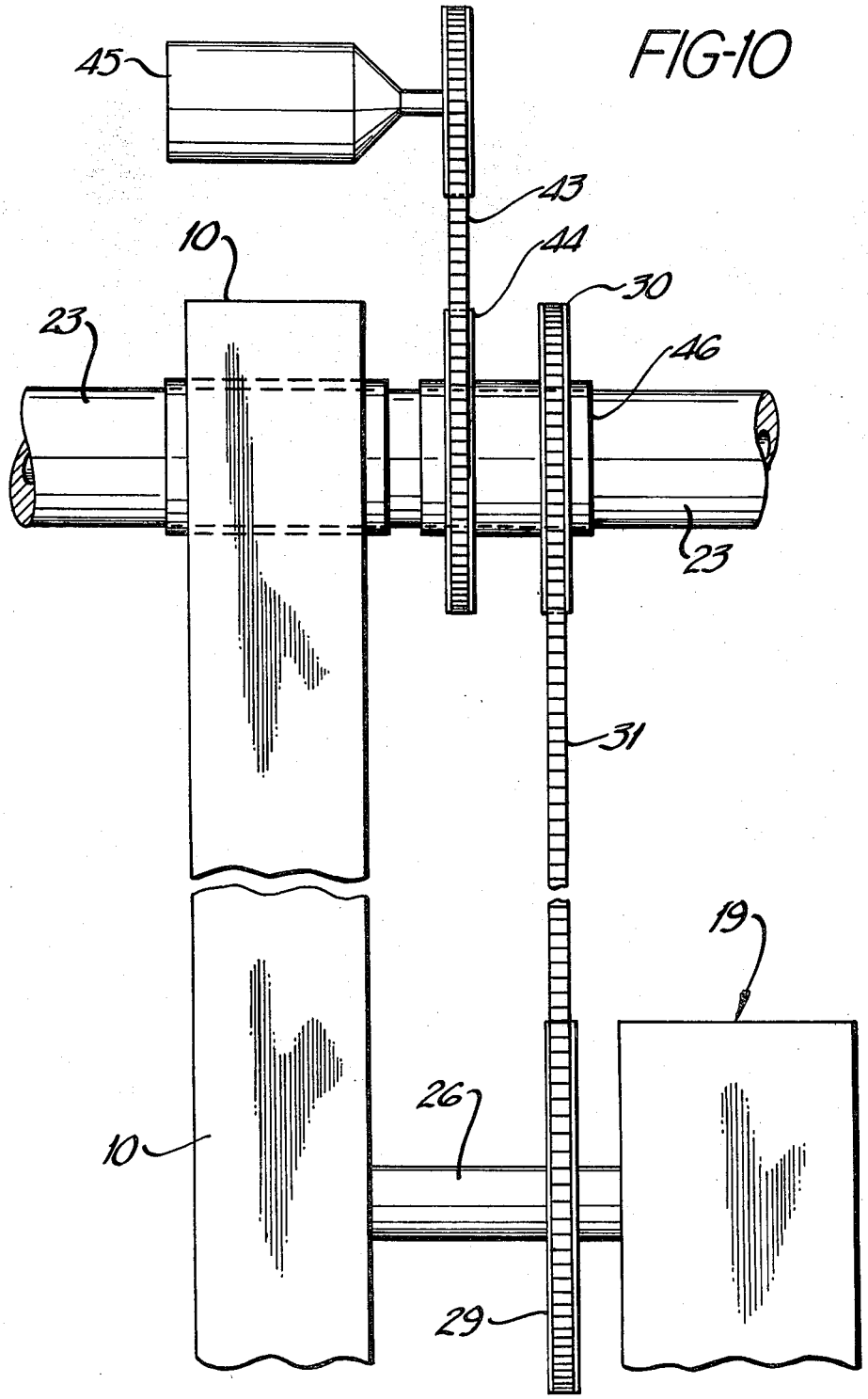
FIG. 10 shows a representative motor drive for synchronizing the alignment of the take-up head.

FIG. 10 shows a suitable arrangement for selectively rotating shaft sprocket 30 wherein a synchronizer sprocket 44 and shaft sprocket 30 are rigidly connected together and rotatable about shaft housing 23 on sleeve bearing 46. A synchronizer drive means, such as drive motor 45, then connects to drive sprocket 44 by means of a suitable drive linkage, such as drive chain 43. Initially, as shown in the sequence of FIGS. 9A and B, a retainer means, such as a brake on drive motor 45, holds sprockets 44 and 30 stationary with respect to shaft housing 23 and thereby operates to counter-rotate take-up head 19 in the manner previously described. When the apparatus reaches the position shown in FIG. 9C, however, the motor brake releases and motor 45 activates driving chain 43 to selectively rotate sprockets 44 and 30 about shaft housing 23 at a velocity synchronous with the rotational velocity of carrier arm 10. The synchronous rotations of sprocket 30 and carrier arm 10 are adopted to hold and maintain a set orientation of take-up head 19 with respect to the approach direction of filament 4 as arm 10 rotates between the positions shown in FIGS. 9C–D.

An alternative synchronizer means is comprised of a dual function retainer means connected to a rotatable shaft sprocket 30, which selectively engages shaft housing 23 and carrier arm 10. While the apparatus is moving between the positions shown in FIGS. 9A, B and C, the retainer engages shaft housing 23 to hold sprocket 30 non-rotatable therewith. Thusly held, sprocket 30 operates to counter-rotate take-up head 19. When the apparatus reaches the position shown in FIG. 9C, the retainer means selectively disengages shaft housing 23 and engages carrier arm 10 to rotate about shaft housing 23 synchronous with carrier arm 10. This terminates the counter-rotation of head 19 and holds it in the desired set orientation. It is readily apparent that the counter-rotation of head 19 may be stopped by other equivalent means. For example, upon disengagement of sprocket 30 from shaft housing 23, a mechanical or magnetic latch means may engage and hold head 19 fixed relative to carrier arm 10.

Actuator means 11, which pivots carrier arm 10 around wheel 5, is comprised of a suitable actuator drive means, such as actuator motor 12; an actuator arm 13; actuator linkage rod 14; linkage arm 41 and a gear means 20, as representatively shown in FIG. 2.

Actuator motor 12 is positioned and mounted on frame 21 and adapted to rotate an actuator arm 13 or the like. The rotation of actuator arm 13 produces a corresponding translational movement of linkage rod 14 which, in turn, moves linkage arm 41 to actuate gear means 20. Gear means 20 comprised of gears 121 and 122 has a gear ratio adapted to provide the desired rotational movement of carrier shaft 27 and carrier arm 10 about shaft housing 23. Linkage arm 41 is suitably connected to rotate gear 121 which in turn engages and rotates gear 122. Since gear 122 is fixedly connected to carrier shaft 27 and concentric therewith, the rotation of gear 122 rotates carrier shaft 27 to move carrier arm 10 about shaft housing 23. In the shown embodiment, linkage arm 41 is sized and selected to move through an arc of about 87°, and gear means 20 is sized and selected to provide a corresponding rotation of carrier arm 10 through an arc of at least about 200°.

Preferably, actuator means 11 includes a rate means for providing a modulated rate of movement of carrier arm 10 about winding wheel 5 having a slow, gradually increasing beginning rate, a faster middle rate and a slow, gradually decreasing ending rate. The rate means of the shown embodiment is comprised of actuator arm 13 and actuator linkage rod 14. Actuator arm 13 is adapted to rotate through an angle of 180°, and its rotation translates linkage rod 14 through a distance approximately equal to twice the effective actuator arm radius 32. This arrangement provides a substantially sinusoidal rate of movement to linkage rod 14 having the desired slow speed at the start of travel, faster speed during the middle part of travel and slow speed at the end of the travel. Since linkage rod 14 operably connects to linkage arm 41 and gear means 20 to move carrier arm 10, the rod movement produces a corresponding sinusoidal rate of movement of the carrier arm about the rotational axis of winding wheel 5. Such a modulated rate avoids sudden movements that may break filament 4 during the transfer around and onto wheel 5.

As actuator means 11 rotates carrier arm 10 and take-up head 19 about shaft housing 23, a segment of filament 4 is placed against the winding surface of wheel 5. A grip means 8, comprising trigger device 6 and grip element 7, then cuts the filament at the winding surface and secures it to wheel 5.

Figure 7:
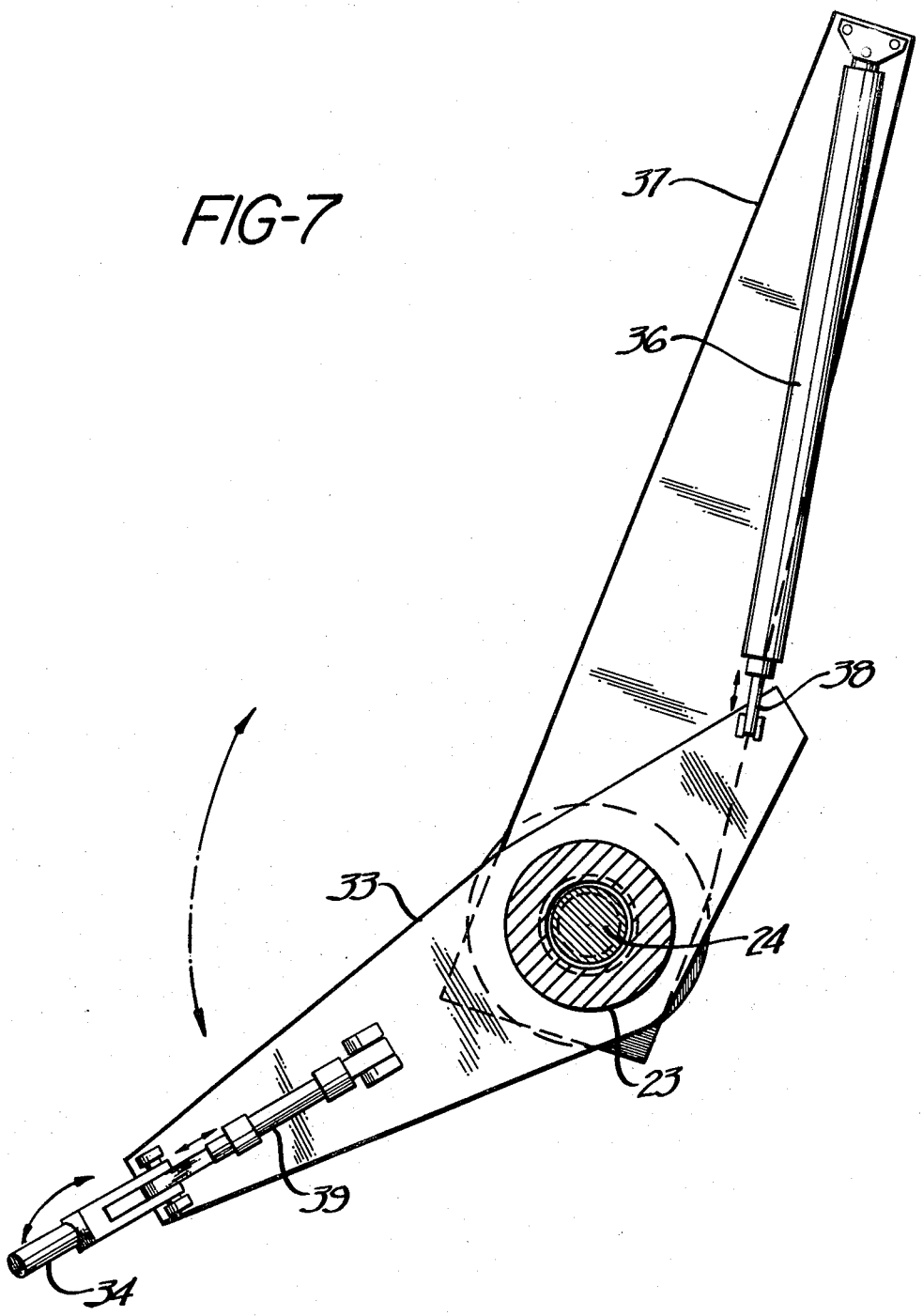
FIG. 7 is a cross-sectional view taken along line B—B of FIG. 5 showing a wrapping arm and hold down roller employed to accentuate the contact arc of the filament around the winding wheel.

Optionally, the apparatus of the invention includes a hold down means for accentuating the contact arc of filament 4 on the winding surface of wheel 5 prior to gripping and cutting the filament. FIG. 7, illustrates a hold down means comprised of a wrapping arm 33, a retractable hold down roller 34, an arm drive means and a roller retract means. Wrapping arm 33 extends radially away from shaft housing 23 and is mounted on bearing 35 which is concentric with and pivotable about the rotational axis of wheel 5. Retractable roller 34 is mounted at the end of wrapping arm 33, and a suitable arm drive means, such as a dual action pneumatic cylinder 36 and rod 38, is adapted to rotate wrapping arm 33 and roller 34 around the rotational axis of wheel 5 through a preselected arc. In the shown embodiment, a bracket 37 is rigidly mounted to shaft housing 23 to provide an attachment base for pneumatic cylinder 36. Upon actuation of pneumatic cylinder 36, rod 38 engages wrapping arm 33 and rotates arm 33 along with roller 34 about wheel 5 to engage and wrap filament 4 around the winding surface of wheel 5. A suitable retract means, such as a dual action pneumatic cylinder 39 mounted on wrapping arm 33, selectively retracts and extends hold down roller 34. When retracted, hold down roller 34 is displaced away from the path of advancing filament 4 and does not interfere with the filament as it is transferred around wheel 5 by carrier arm 10. When extended, hold down roller 34 can be brought to engage and wrap filament 4 around the winding surface of wheel 5 as wrapping arm 33 is rotated about shaft housing 23.

Figure 4A:
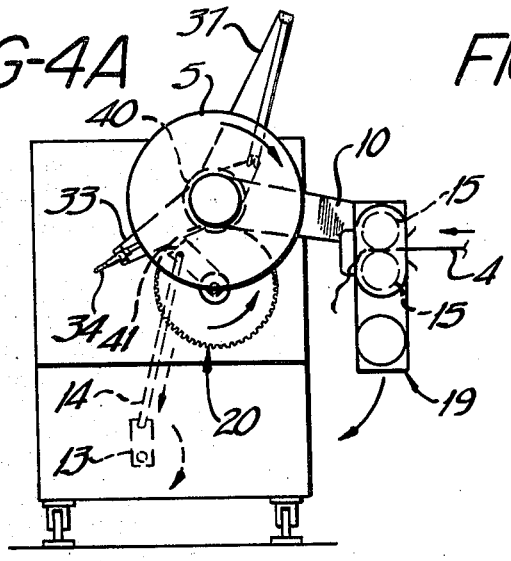
FIGS. 4A, B, C, D and E show schematically the operation sequence of an alignment means in conjunction with the hold means of the invention.
Figure 4B:
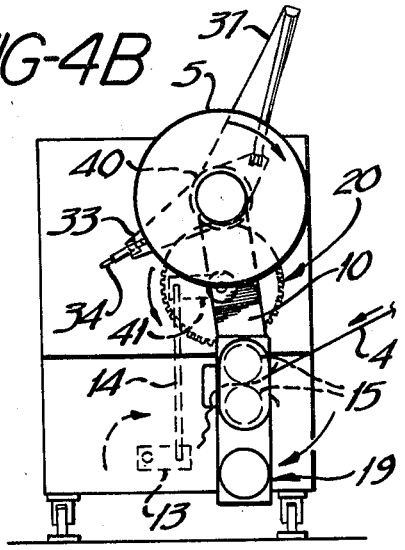
Figure 4C:
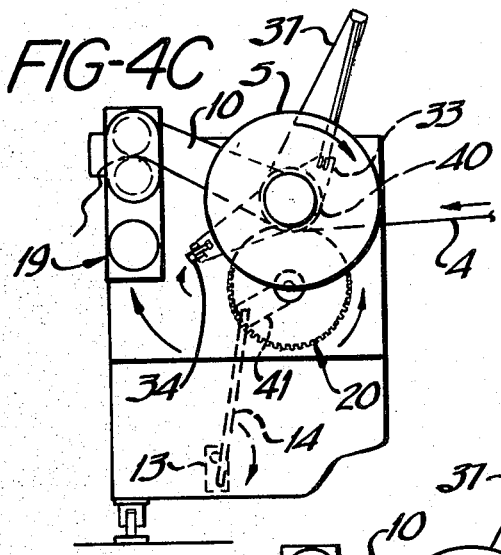
Figure 4D:
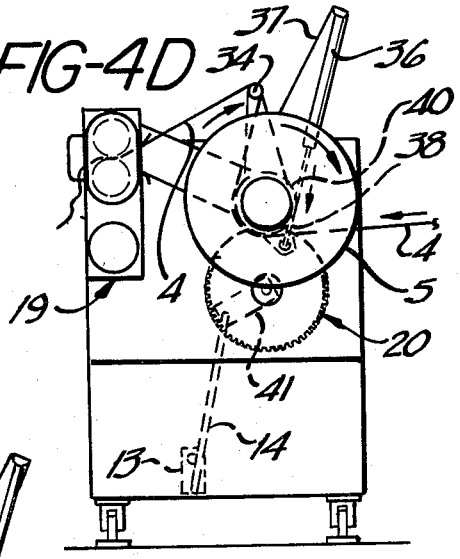
Figure 4E:
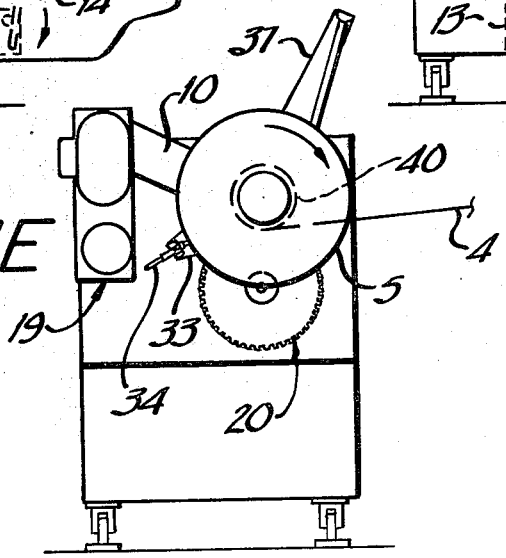

FIGS. 4A, B, C, D and E show schematically the operational sequence of stringing-up filament 4 onto winding wheel 5 with an apparatus having a hold down means. In FIG. 4A, the nip of the brush rollers 15 is aligned with a casting operation to capture a leading edge of the advancing filament in the nip of brush rollers 15. Wrapping arm 33 is positioned at an initial position as shown with hold down roller 34 retracted to avoid contact with filament 4 as it passes. After starting the casting operation, advancing filament 4 is captured and tensioned in take-up head 19. Next, actuator means 11 is activated to pivot carrier arm 10 clockwise, moving take-up head 19, along with captured filament 4, around shaft housing 23. FIG. 4B shows carrier 10 and take-up head 19 at an intermediate position illustrating the manner in which the initial orientation of take-up head 19 is being maintained by operation of the alignment means. In FIG. 4C, carrier arm 10 has swung to position take-up head 19 above and behind winding wheel 5, contacting filament 4 with winding surface 40. The rotational velocity of wheel 5 has been previously adjusted to match the peripheral velocity of the advancing filament. Pneumatic cylinder 39 is now activated to extend hold down roller 34, and pneumatic cylinder 36 is activated to rotate wrapping arm 34 about shaft housing 23. FIG. 4D illustrates wrapping arm 33 after it has pivoted clockwise carrying roller 34 in a path passing between take-up head 19 and winding wheel 5 to contact and to wrap filament 4 around the winding surface of wheel 5. This movement accentuates the contact arc of filament 4 on the winding surface of wheel 5 prior to cutting and gripping the filament. While the described embodiment incorporates a clockwise movement of wrapping arm 33, it is readily apparent that arm 33 may also by moved counter-clockwise to produce a substantially equivalent result. FIG. 4E, illustrates the apparatus after the cut grip operation where hold down roller 34 has been retracted to release filament 4 and allow the inline winding to proceed. The various movements and operations of the apparatus are timed and sequenced by using conventional devices, such as limit switches, cam assemblies, photosensors and the like.

When the cut and grip element 7 on the rotating winder is actuated, a certain amount of time elapses during the fall of the element 7. An angle of rotation of the rotating winder wheel, termed the "fall angle", corresponds to this time interval and depends on the rotational speed. Since different alloy compositions are cast at different casting speeds, the rotational speed of wheel 5 must be adjusted accordingly to accommodate the different casting speeds. When wheel 5 rotates at a relatively slow speed, the corresponding fall angle is small, and trigger device 6 must be triggered within a small distance of the segment of filament 4 contacting winding surface 40 to effect the grip and cut operation. When wheel 5 rotates at a higher speed, the corresponding fall angle is larger, and trigger device 6 must be triggered within a larger distance of the filament segment contacting the winding surface. By maximizing the contact arc of filament 4 on the winding surface, the apparatus provides a larger target window toward which to direct the cut and grip device and accommodates a wider range of fall angles without need for readjusting the trigger timing of trigger device 6. The invention is especially effective for maximizing this contact arc since the take-up head and optional hold down means rotate around wheel 5 and can be adapted to provide about 200° of filament contact arc against winding surface 40.

Having thus described the invention in rather full detail, it will be understood that these details need not be strictly adhered to but that various changes and modifications may suggest themselves to one skilled in the art, all falling within the scope of the invention as defined by the subjoined claims.

We claim:

1. An apparatus for the inline string-up of a rapidly advancing filament from a continuous forming operation on to a winding wheel rotating about a concentric axis of rotation, comprising:

(a) a take-up head for capturing and tensioning the advancing segment of said filament, said pickup head rotatable about a head axis positioned substantially parallel to said winding wheel axis;

(b) a carrier arm extending radially from said winding wheel axis, said arm connected to said take-up head at said head axis and further connected to pivot concentrically about said winding wheel axis;

(c) actuator means for pivoting said carrier arm about said winding wheel axis to move said pick-up head around said winding wheel and contact a segment of said filament with a winding surface of said wheel; and (d) grip means for severing said filament at the winding surface and securing the advancing segment of said filament onto the winding wheel.

2. An apparatus as recited in claim 1, wherein said take-up head is comprised of two nipping brush rollers, which have selectable interference and speed of counter-rotation, adapted to pass said filament through the nip thereof and tension said filament in a sliding frictional manner.

3. An apparatus as recited in claim 1, wherein said take-up head is comprised of an aspirator means.

4. An apparatus as recited in claim 1, further comprising an alignment means for maintaining said take-up head in a preselected orientation with respect to the advancing filament as said carrier arm pivots about said winding wheel axis.

5. An apparatus as recited in claim 4 wherein said alignment means comprises:

(a) a shaft sprocket rigidly mounted concentric and non-rotatable with respect to said winding wheel rotational axis;

(b) a head sprocket rigidly mounted to said take-up head and concentric with said head axis; and (c) a continuous loop drive linkage which engages said shaft sprocket and said head sprocket.

6. An apparatus as recited in claim 4, wherein said alignment means comprises:

(a) a head sprocket connected to said take-up head and concentric with said head axis;

(b) a shaft sprocket mounted concentric and selectively rotatable with respect to said winding wheel rotational axis;

(c) a continuous loop drive linkage which engages said shaft sprocket and said head sprocket; and (d) synchronizer means for selectively rotating said shaft sprocket in coordination with the movement of said carrier arm to provide a substantially direct, straight-in approach direction of said filament into said nip.

7. An apparatus as recited in claim 6, wherein said synchronizer means comprises:

(a) a synchronizer drive linkage connected to said shaft sprocket;

(b) a synchronizer drive motor connected to said synchronizer linkage and adapted to selectively rotate said shaft sprocket in coordination with the movement of said carrier arm to provide a substantially direct, straight-in approach of said filament into said nip.

8. An apparatus as recited in claim 1, further comprising a hold down means for accentuating the contact arc of the filament on the winding surface prior to gripping and severing said filament.

9. An apparatus as recited in claim 8, wherein said hold down means comprises:

(a) a wrapping arm extending radially from and pivotable about the rotational axis of said winding wheel;

(b) a retractable hold down roller mounted at the end of said arm and adapted to selectively extend and engage said filament as said arm pivots about said axis; and (c) drive means for pivoting said arm and said hold down roller about said axis to engage and wrap said filament around the winding surface of said winding wheel.

10. An apparatus as recited in claim 1, wherein said actuator means further comprises a rate means for providing a modulated rate of movement of said carrier arm about said axis having a slow beginning rate, a faster middle rate, and a slow ending rate.

11. An apparatus as recited in claim 10, wherein said rate means is adapted to provide a substantially sinusoidal rate of movement.

12. An apparatus of claim 10, wherein said actuator means comprises:

(a) an actuator linkage;

(b) a rotatable actuator arm connected to drive said linkage with the rotation of said actuator arm being adapted to provide a substantially sinusoidal rate of movement thereto;

(c) drive means connected to rotate said actuator arm; and (d) gear means operably connected to said linkage and adapted to move said carrier arm about the rotational axis of said winding wheel at a sinusoidal rate of motion corresponding to the rate of said linkage.

13. A method for the inline string-up of a rapidly advancing filament from a continuous forming operation onto a winding wheel rotating about a concentric axis of rotation, comprising the steps of:

(a) capturing an advancing segment of said filament in a take-up head;

(b) moving said take-up head along a substantially circular path around the rotational axis of said winding wheel with a carrier arm which pivots concentrically about said winding wheel axis to contact a segment of said filament with a winding surface of said winding wheel;

(c) severing said filament at the winding surface; and (d) securing the advancing segment of said filament onto said winding wheel.

14. A method as recited in claim 13, further comprising the step of maintaining said take-up head in a preselected orientation with respect to the advancing filament as said take-up head moves about the rotational axis of said wheel.

* * * * *